US007320852B2

(12) United States Patent
Kotsugai et al.

(10) Patent No.: US 7,320,852 B2
(45) Date of Patent: Jan. 22, 2008

(54) CARRIER FOR DEVELOPER FOR DEVELOPING ELECTROSTATIC LATENT IMAGE, DEVELOPER USING SAME AND IMAGE FORMING METHOD USING SAME

(75) Inventors: Akihiro Kotsugai, Numazu (JP); Kimitoshi Yamaguchi, Numazu (JP); Naoki Imahashi, Mishima (JP); Hiroaki Takahashi, Sunto-gun (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/392,869

(22) Filed: Mar. 21, 2003

(65) Prior Publication Data

US 2003/0224279 A1 Dec. 4, 2003

(30) Foreign Application Priority Data

Mar. 22, 2002 (JP) ..... 2002-079898

(51) Int. Cl.
*G03G 9/10* (2006.01)

(52) U.S. Cl. ..... 430/111.3; 430/111.35; 430/122.2; 430/122.4; 430/123.58

(58) Field of Classification Search ..... 430/111.1, 430/111.32, 111.33, 111.35, 111.41, 111.31, 430/122.2, 122.4, 122.6, 122.7, 123.58, 111.3
See application file for complete search history.

(56) References Cited

U.S. PATENT DOCUMENTS

| | | | | |
|---|---|---|---|---|
| 3,678,897 | A * | 7/1972 | Hewitt | 399/294 |
| 3,839,029 | A * | 10/1974 | Berg et al. | 430/120 |
| 3,974,078 | A * | 8/1976 | Crystal | 430/110.2 |
| 5,019,295 | A * | 5/1991 | Yoshida et al. | 252/519.31 |
| 5,733,480 | A * | 3/1998 | Lee et al. | 252/511 |
| 5,733,962 | A * | 3/1998 | Osako et al. | 524/449 |
| 5,935,753 | A * | 8/1999 | Ohishi et al. | 430/110.4 |
| 5,961,887 | A * | 10/1999 | Zheng et al. | 252/502 |
| 6,235,443 | B1 * | 5/2001 | Kayamoto et al. | 430/111.1 |
| 6,319,646 | B1 * | 11/2001 | Suganuma | 430/111.4 |
| 6,416,919 | B1 * | 7/2002 | Yanagida et al. | 430/122 |
| 6,472,118 | B1 | 10/2002 | Yamaguchi et al. | 430/111.35 |
| 6,489,073 | B2 | 12/2002 | Kotsugai et al. | 430/97 |

FOREIGN PATENT DOCUMENTS

| | | | |
|---|---|---|---|
| JP | 01-101560 | * | 4/1989 |
| JP | 5-181322 | | 7/1993 |
| JP | 6-295108 | | 10/1994 |
| JP | 7-160059 | | 6/1995 |
| JP | 7-271194 | | 10/1995 |
| JP | 8-227225 | | 9/1996 |
| JP | 9-190018 | | 7/1997 |
| JP | 9-269614 | | 10/1997 |
| JP | 11-101560 | | 7/1999 |
| JP | 2000-10350 | | 1/2000 |
| JP | 2000-98666 | | 4/2000 |
| JP | 2000-221733 | | 8/2000 |
| JP | 2001-51456 | | 2/2001 |
| JP | 2002-82472 | | 3/2002 |

OTHER PUBLICATIONS

Japanese Patent Office English-Language Abstract Describing JP 01-101560, Copyright 1998, 2003.*
Schaffert, R.M., *Electrophotography*, John Wiley & Sons, NY (1975), pp. 36-38.*
Grant, R. et al., eds., *Grant & Hackh's Chemical Dictionary*, Fifth Edition, McGraw-Hill Book Co., NY (1987), p. 503.*
USPTO English-language translation of JP 01-101560 (pub. Apr. 1989).*
Grant, R., et al., ed., *Grant & Hackh's Chemical Dictionary*, 5th edition, McGraw-Hill Book Company, NY (1987), p. 531.*
U.S. Appl. No. 10/726,669, filed Dec. 4, 2003, Kotsugai et al., originally filed claims, abstract, and figure.
U.S. Appl. No. 10/977,013, filed Nov. 1, 2004, Yamaguchi et al.
U.S. Appl. No. 10/959,663, filed Oct. 7, 2004, Sugiura et al.
U.S. Appl. No. 10/875,402, filed Jun. 25, 2004, Sugiura et al.
U.S. Appl. No. 10/802,754, filed Mar. 18, 2004, Yamaguchi et al., originally filed claims, abstract, and drawings.
U.S. Appl. No. 11/373,109, filed Mar. 13, 2006, Imahashi et al.
U.S. Appl. No. 11/508,922, filed Aug. 24, 2006, Imahashi et al.

* cited by examiner

*Primary Examiner*—Janis L. Dote
(74) *Attorney, Agent, or Firm*—Oblon, Spivak, McClelland, Maier & Neustadt, P.C.

(57) ABSTRACT

A carrier for use with a toner as a two-component type developer for developing an electrostatic image, comprising spherical magnetic core particles, and a resin layer covering each of said core particles and containing at least two resistance controlling materials having different specific resistances, wherein each of the resistance controlling materials is in the form of particles having a number average particle diameter of no more than 1/10 of a number average particle diameter of the toner.

18 Claims, No Drawings

CARRIER FOR DEVELOPER FOR DEVELOPING ELECTROSTATIC LATENT IMAGE, DEVELOPER USING SAME AND IMAGE FORMING METHOD USING SAME

BACKGROUND OF THE INVENTION

This invention relates to a carrier for a developer for developing an electrostatic latent image, to an electrostatic latent image developer using the carrier, and to an image forming method by electrophotography, electrostatic recording, electrostatic printing, etc. using the developer.

In the field of image forming apparatuses utilizing electrophotography, such as copying machines and printers, various studies are now made on an electrostatic latent image developing system for the purpose of improving the duration and images reproducibility. In such an image forming apparatus, an electrostatic latent image formed on an image forming member such as a photoconductor is developed with a developer supported on a developer carrying member. One-component type developers composed of a magnetic or non-magnetic toner and two-component type developers composed of a toner and a magnetic carrier are known as the developer. The two-component type developers are advantageous over the one-component type developer, because of easiness in high speed toner feeding and in uniformizing chargeability of toner, which characteristics in turn permit high speed image forming and production of high grade images.

In development of an electrostatic latent image on an image forming member with a two-component type developer supported on a developer carrying member, an electric field is formed in a gap between the latent image bearing member serving as an electrode and the developer carrying member serving as a counter electrode, in which gap the carrier is present. Thus, since the carrier present between the electrodes has an influence upon the electric field, the electrical properties of the carrier has a great influence upon the quality of image produced. It is therefore important that the carrier should have uniform electrical properties in order to improve the image quality and for preventing image defects. In particular, it is important that a difference in electric resistance between carrier particles should be minimized in order to prevent deposition of the carrier onto surfaces of the image forming member such as a photoconductor (carrier deposition). Such carrier deposition is apt to occur when the electric resistance of the carrier particles is not uniform. Susceptibility of a carrier to dielectric breakdown is also a cause of carrier deposition. In addition, image defects such as white spots and discharge marks are also caused as a result of the dielectric breakdown of the carrier, especially when an AC bias having a large amplitude is applied between the image forming member and the developer carrying member.

Japanese Laid-Open Patent Publications No. H09-319,161, No. H09-269614 and H10-186731 disclose a carrier including core particles each surrounded by an outer layer containing a resin matrix in which thermosetting resin particles and fine particles of an electric conductivity imparting material are dispersed for improve anti-spent property (prevention of deposition of toner components onto carrier) and strength of the outer layer and for controlling electrical properties of the carrier. The known carrier, however, does not solve the problem of variation of electric resistance between carrier particles.

In the development of an electrostatic latent image with a two-component type developer using the carrier as a magnetic brush, it is proposed to displace the image forming member and the developer carrying member at different linear speeds for the purpose of ensure a sufficient amount of the developer which comes in contact with the latent image in a developing zone. However, such a difference in liner speeds brings about the following abnormal images: (a) a solid image has a portion in which the image density is low or almost zero (white) at an end portion thereof in a displacing direction of the latent-image-bearing image forming member, (b) a halftone image has a portion in which the image density is low or almost zero (white) at an end portion thereof in a displacing direction of the latent-image-bearing image forming member, and (c) the image density is changed at the boundary between the solid image and the halftone image. Such abnormal images are apt to appear at the boundary between the adjacent latent images in which the electric potentials of latent image abruptly change discontinuously. Such abnormal images are thus considered to result from the facts that the toner in the magnetic brush can move due to the sliding contact between the magnetic brush and the latent image and that a layer of developer, which is a dielectric member, passes through a discontinuous electric field.

SUMMARY OF THE INVENTION

It is, therefore, an object of the present invention to provide a carrier for a developer which is devoid of the drawbacks of the conventional carrier.

Another object of the present invention is to provide a carrier which, when used as a two-component type developer, can form a good quality image free of background stains and white spots for a long period of service.

It is a further object of the present invention to provide a two-component type developer which can give fine line images and small dot images with good reproducibility and good resolution.

It is a further object of the present invention to provide an image forming method which can give good quality images.

In accomplishing the foregoing objects, the present invention provides a carrier for use with a toner as a two-component type developer for developing an electrostatic image, comprising spherical magnetic core particles, and a resin layer covering each of said core particles and containing at least two resistance controlling materials having different specific resistances, wherein each of the two resistance controlling materials is in the form of particles having a number average particle diameter of no more than 1/10 of a number average particle diameter of the toner.

As a consequence of the above construction, the carrier of the present invention can provide a two-component type developer capable forming images free of background stains and white spots and of affording fine line images and small dot images. Although not wishing to be bound by the theory, the above advantages are considered to result from the following reasons. Namely, as a consequence of the presence of fine particles of two different resistance controlling materials, there is formed, in a region on a surface of the carrier particle which region is sufficiently small as compared with the diameter of the toner, a proper degree of non-uniformity or irregularity in electric resistance. Because of such irregularity in electric resistance, there are formed an electric field therebetween so that the toner particle in contact with the carrier can be suitably charged and retained on the carrier as compared with a known carrier in which carbon black alone is dispersed in an outer resin layer surrounding a magnetic core. Additionally, because a relatively high electric resistance material is used in conjunction with a relatively low electric resistance material, the electric resistance of the carrier particles as a whole can be more easily and precisely adjusted and a difference in electric resistance between respective carrier particles can be made smaller, as compared with the known carrier in which carbon black alone is dispersed in an outer resin layer surrounding a magnetic core. Namely, in the case of the conventional carrier, a slight variation of the conditions under which the surface resin layer is formed over the magnetic core will cause a change in the uniformity of the distribution of the carbon black in the resin layer.

In another aspect, the present invention provides a developer for developing an electrostatic image, which comprises the above carrier.

The developer may comprise a non-magnetic toner having a number average particle diameter in the range from 5 μm to 8 μm and the carrier of the invention.

The present invention also provides an image forming method comprising contacting an image forming member bearing an electrostatic latent image thereon with the above developer magnetically supported on a developer carrying member, while impressing an electric potential between said image forming member and said developer carrying member, to electrostatically move said toner of said developer to the electrostatic latent image and to form a toner image on said image forming member.

Other objects, features and advantages of the present invention will become apparent from the detailed description of the preferred embodiments of the invention to follow.

DETAILED DESCRIPTION OF THE PREFERRED EMBODIMENTS OF THE INVENTION

A carrier for use with a toner as a two-component type developer according to the present invention comprises spherical magnetic core particles, and a resin layer covering each of the core particles and containing at least two different resistance controlling materials having different specific resistances.

It is important that the number average particle diameter Dp of each of the two resistance controlling materials is no more than 1/10 of a number average particle diameter Dn of the toner ($Dp \leqq Dn/10$). When the particle diameter Dp of the resistance controlling materials is greater than 1/10 of the average particle diameter Dn ($Dp > Dn/10$), the surface resistance of the carrier becomes non-uniform and varies with the location thereof so that part of the toner particles on the carrier are not sufficiently charged, resulting in scattering of the released toner particles from the developing zone and in background stains of the produced copies or prints. Preferably, the particle diameter Dp of the resistance controlling materials is not smaller than 1/500 of the average particle diameter Dn ($Dp \geqq Dn/500$) for obtaining suitable irregularity of the electric resistance. The electric resistance controlling materials may be, for example, metal powder such as Al powder, electroconductive ZnO powder, $SnO_2$ powder prepared by various methods, powder of $SnO_2$ doped with a suitable element, powder of a variety of borides such as $TlB_2$, $ZnB_2$ and $MoB_2$, silicon carbide powder, electroconductive polymeric material powder such as polyacetylene, poly(p-phenylene), and poly(p-phenylene sulfide) or polypyrrole, carbon black, or a relatively high electric resistance metal oxide (such as silica or alumina) treated with a conductive material such as carbon black, a conductive metal or a conductive metal oxide.

It is preferred that one of the resistance controlling materials have a specific resistance of $1\times10^3$ Ω·cm or less and one of the other resistance controlling materials have a specific resistance of $5\times10^7$ Ω·cm or less.

It is also preferred that one of the resistance controlling materials is electrically conductive carbon particles or metal oxide particles treated to have electrical conductivity.

Any binder customarily used for coating a core material of carriers may be employed in the present invention. Examples of the binder include tetrafluoroethylene resins, monochlorotrifluoroethylene resins, polyvinylidene fluoride resins, silicone resins, polystyrene resins (e.g. polystyrene, chloropolystyrene, poly-α-methylstyrene, styrene-chlorostyrene copolymers, styrene-propylene copolymers, styrene-butadiene copolymers, styrene-vinyl chloride copolymers, styrene-maleic acid copolymers, styrene-acrylate copolymers (acrylate may be for example methyl acrylate, ethyl acrylate, butyl acrylate, octyl acrylate or phenyl acrylate), styrene-methacrylate copolymers (methacrylate may be for example methyl methacrylate, ethyl methacrylate, butyl methacrylate, octyl methacrylate or phenyl methacrylate), styrene-methyl α-chloroacrylate copolymers and styrene-acrylonitrile-acrylate copolymers), polyester resins, acrylic resins (e.g. polyacrylic resins, polymethacrylic resins, ethylene-ethylacrylate resins and aminoacrylate resins), polyamide resins, polyvinylbutyral resins and mixtures thereof.

The preferred binder resin is a silicone resin or a mixture thereof with the above-described resins for reasons of prevention of spent problems of toner, good toner bearing efficiency and good developing efficiency. The silicone resin may be, for example, a compound having recurring units represented by any one of the following formulas:

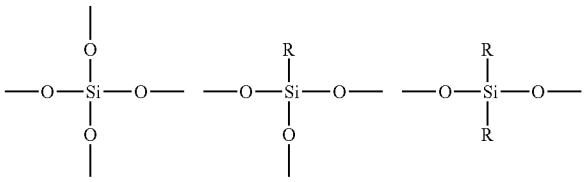

wherein R represents a hydrogen atom, a halogen atom, a hydroxyl group, a methoxyl group, a lower alkyl group having 1-4 carbon atoms or a phenyl group.

The silicone resin may be a straight silicone resin or a modified silicone resin. Specific examples of the silicone resins are straight-silicone resins, such as "KR271", "KR272", "KR282", "KR252", "KR255", and "KR152" (manufactured by Shin-Etsu Chemical Co., Ltd.); and "SR2400" and "SR2406" (manufactured by Dow Corning Toray Silicone Co., Ltd.), modified silicone resins, such as epoxy-modified silicone, acryl-modified silicone, phenol-modified silicone, urethane-modified silicone, polyester-modified silicone and alkyd-modified silicone. As such modified silicone resins, there are commercially available epoxy-modified silicone "ES-1001N", acryl-modified silicone "KR-5208", polyester-modified silicone "KR-5203", alkyd-modified silicone "KR-206", and urethane-modified silicone "KR-305" (manufactured by Shin-Etsu Chemical Co., Ltd.); and epoxy-modified silicone "SR2115" and alkyd-modified silicone "SR2110" (manufactured by Dow Corning Toray Silicone Co., Ltd.).

These silicone resins have suitable electric resistance, low surface energy and good film forming properties required for coating magnetic cores.

Any conventionally employed core material for carriers of two-component developers may be used for the purpose of the present invention. Examples of carrier core materials include ferromagnetic materials such as iron and cobalt, magnetite, hematite, Li ferrite, Mn—Zn ferrite, Cu—Zn ferrite, Ni—Zn ferrite, Ba ferrite, Mn—Mg ferrite and Mn ferrite. Ferrite is a sintered material generally represented by the formula:

$$(MO)_x(NO)_y(Fe_2O_3)_z$$

wherein x+y+z=100 mol %, and M and N are metals such as Li, Sr, Ca, Mg, Ba, Cu, Zn, Mn, Fe, Ni and Cd.

Resin dispersed core particles each containing magnetic powder dispersed in a resin matrix such as a phenol resin, an acrylic resin or a polyester resin may also be used.

The resin layer may contain a charge controlling agent. The charge controlling agent may be a nitrogen-containing organic silicone compound.

One or more silane coupling agents may also be added in the silicone resin-containing coating layer as a charge controlling agent to improve chargeability and film forming property. Silane coupling agent represented by the following general formula may be suitably used:

$$X—Si(R^1)_m(OR)_n$$

wherein X is either a functional group which is reactive or adsorbent to either organic or inorganic materials or a saturated or unsaturated hydrocarbon chain with such a functional group as described above, $R^1$ represents a hydrocarbyl group, OR is an alkoxyl group, m is an integer of 0-2 and n is an integer of from 1 to 3. As the silane coupling agent, an aminosilane coupling agent having an amino group as the X group is preferably used in the present invention for reasons of improved chargeability and film forming property. Examples of aminosilane coupling agents are given below together with the molecular weight thereof:

| | |
|---|---|
| $H_2N(CH_2)_3Si(OCH_3)_3$ | MW: 179.3 |
| $H_2N(CH_2)_3Si(OC_2H_5)_3$ | MW: 221.4 |
| $H_2N(CH_2)_3Si(CH_3)_2OC_2H_5$ | MW: 161.3 |
| $H_2N(CH_2)_3SiCH_3(OC_2H_5)_2$ | MW: 191.3 |
| $H_2N(CH_2)_2NHCH_2Si(OCH_3)_3$ | MW: 194.3 |
| $H_2N(CH_2)_2NH(CH_2)_3SiCH_3(OCH_3)_2$ | MW: 206.4 |
| $H_2N(CH_2)_2NH(CH_2)_3Si(OCH_3)_3$ | MW: 224.4 |
| $(CH_3)_2N(CH_2)_3SiCH_3(OC_2H_5)_2$ | MW: 219.4 |
| $(C_4H_9)_2N(CH_2)_3Si(OCH_3)_3$ | MW: 291.6 |

If desired, one or more other additives, such as dyes, pigments and magnetic materials may be incorporated into the resin layer.

The resin layer may be formed by any conventional method such as spray drying, immersion, powder coating, fluidized bed coating. The fluidized bed coating may be used for forming a resin layer having a uniform thickness. In such a coating method, a coating liquid containing a resin or a precursor thereof (such as monomer or oligomer thereof), at least two electric resistance controlling materials and optional additives dispersed in a suitable solvent is generally used.

It is preferred that the carrier have an electric resistance $10^7$ to $10^{16}$ Ω·cm. Too low an electric resistance is apt to form a solid image having a mark of a magnetic brush appearing as varied image densities, whereas too high an electric resistance will cause carrier deposition, developing failure due to charge-up of the carrier and remarkable differences in image density between an edge portion and a solid portion or between a line image and a solid image.

The carrier resistance as used herein is measured using a cell made of a fluorine resin cell in which a pair of spaced apart electrodes are disposed to define a predetermined gap of 2 mm. Each of the electrodes has a length of 40 mm and a height of 20 mm. In the gap, carrier particles are filled. Between the electrodes 12a and 12b, a DC voltage of 500 V is applied. Resistance R (Ω·cm) is measured with a high resistance meter (Model 4329A manufactured by Yokokawa Hewlett Packard Inc.).

The resin layer preferably has an average thickness of from 0.4 μm to 2 μm, more preferably 0.4 to 1 μm.

The thickness of the resin layer may be measured by any suitable method. When the true specific gravities of the carrier core material and the resin layer material are known, the thickness of the resin layer may be determined by measuring the true specific gravity of the carrier. More conveniently, the thickness of the resin layer may be measured by electron microscope of the cross-section of the carrier formed by crushing the carrier. The thickness herein is an average thickness. It is preferred that the average thickness of the resin layer is greater than the number average particle diameter of each of the resistance controlling materials is smaller than an average thickness of said resin layer.

The carrier thus constructed is combined with a non-magnetic toner to form a two-component developer. In general, the toner is used in an amount of 0.5 to 15% by weight based on a total weight of the toner and the carrier. The use of non-magnetic toner is preferably, because otherwise the carrier has a tendency to be separated from the toner for reasons of a difference in a magnetic moment therebetween and a difference in a specific gravity therebetween. Further, the magnetic toner is apt to accumulate in top regions of a magnetic brush or in interstices between carrier particles so that the toner is not uniformly fed to the electrostatic latent image, resulting in non-uniformity of the image and lack of fine dots or lines in a half tone image.

In one preferred image forming method according to the present invention, the above two-component type developer of the present invention is magnetically supported on a developer carrying member, such as a developing sleeve, within which a magnet is stationarily or rotatably accommodated. The developer carrying member is disposed to face an image forming member, such as a photoconductor, bearing an electrostatic latent image thereon to form a developing zone therebetween. When the developer carrying member is displaced, the developer magnetically supported thereto is continuously fed to the developing zone and is brought into contact with the electrostatic latent image on the image forming member. An electric potential is applied between the image forming member and the developer carrying member to selectively move the toner of the developer to the electrostatic latent image and to form a toner image on the image forming member.

In the above developing method, the electrostatic latent image-bearing image forming member is also displaced at a linear speed different from that of the developer carrying member. When the image forming member and the developer carrying member are displaced in the same direction at different linear speeds Vp [mm/sec] and Vr [mm/sec], respectively, it is preferred that the Vp and Vr meet the following condition:

$$0.1 \leqq L \times \{(Vr/Vp)-1\} \leqq 2.$$

wherein L a length (mm), in the displacing direction, of contact between the developer and the image forming member.

Since the developer according to the present invention has improved uniformity in electrical resistance between carrier particles and improved retentivity of toner on the carrier particles, it is possible to reduce the difference in displacing speed between the developer carrying member and the image forming member and, at the same time, to reduce the contact length between the developer and the image forming member, for the purpose of avoiding the occurrence of the above-mentioned abnormal images. However, when $L \times \{(Vr/Vp)-1\}$ is excessively small, sufficient image density may not be obtained.

The toner generally contains a binder resin such as a thermoplastic resin, a coloring agent and, optionally, additive particulates such as a charge controlling agent and a releasing agent. The toner may be prepared by any suitable known method including, for example, polymerization, pulverization and classification with air classifier.

Specific examples of the binder resin for use in the toner include:

vinyl resins including homopolymers of styrene and substituted styrenes such as polystyrene and polyvinyltoluene; styrene-based copolymers such as styrene-p-chlorostyrene copolymer, styrene-propylene copolymer, styrene-vinyltoluene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinylmethyl ether copolymer, styrene-vinylmethyl ketone copolymer, styrene-butadiene copolymer, styrene-isoprene copolymer, styrene-maleic acid copolymer and styrene-maleic acid ester copolymer; poly(methyl methacrylate), poly(butyl methacrylate), poly(vinyl chloride), poly(vinyl acetate), and poly(vinyl butyral); and other resins such as polyethylene, polypropylene, polyester, polyurethane, epoxy resin, rosin, modified rosin, terpene resin, phenolic resin, aliphatic hydrocarbon resin, aromatic petroleum resin, paraffin chlorinated and paraffin wax.

The above-mentioned polyester resin can be prepared by polycondensation of an alcohol and an acid. Examples of the alcohol for preparation of the polyester resin include diols such as polyethylene glycol, diethylene glycol, triethylene glycol, 1,2-propylene glycol, 1,3-propylene glycol, 1,4-propylene glycol, neopentyl glycol, and 1,4-butenediol; etherified bisphenols such as 1,4-bis(hydroxymethyl)cyclohexane, bisphenol A, hydrogenated bisphenol A, a reaction product of polyoxyethylene and bisphenol A, and a reaction product of polyoxypropylene and bisphenol A; dihydric alcohol monomers of the above-mentioned alcohols having a substituent such as a saturated or unsaturated hydrocarbon group with 3 to 22 carbon atoms; other dihydric alcohol monomers; and polyhydric alcohol monomers having three or more hydroxyl groups, such as sorbitol, 1,4-sorbitan, pentaerythritol, dipentaaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene. The epoxy resins may be polycondensation products prepared by reaction of bisphenol A and epichlorohydrin and commercially available as, for example, EPOMIC R362, R364, R365, R366, R367, R369 (products of Mitsui Chemicals, Inc.), EPOTOHTO YD-011, YD-014, YD-904, YD-017 (products of Tohto Chemical Co., Ltd.), EPIKOTE 1002, 1004, 1007 (products of Shell Chemicals Ltd.). Examples of the acids for the preparation of polyester resin include monocarboxylic acids such as palmitic acid, stearic acid, and oleic acid; dicarboxylic acid monomers such as maleic acid, fumaric acid, mesaconic acid, citraconic acid, terephthalic acid, cyclohexane-dicarboxylic acid, succinic acid, adipic acid, sebacic acid, and malonic acid, each of which may have as a substituent a saturated or unsaturated hydrocarbon group having 3 to 22 carbon atoms; anhydrides of the above-mentioned acids; dimers of a lower alkyl ester and linolenic acid; polycarboxylic acid monomers such as 1,2,4-benzenetricarboxylic acid, 1,2,5-benzenetricarboxylic acid, 2,5,7-naphthalenetricarboxylic aid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, and 1,2,7,8-octanetetracarboxylic acid; and anhydrides of the above acids.

As the coloring agent for use in the toner, any conventional pigments and dyes can be employed. Specific examples of the coloring agent include carbon black, Lamp Black, iron black, ultramarine, nigrosine dye, Aniline Blue, Phthalocyanine Blue, Hansa Yellow X, Rhodanine 6G Lake, Chalco Oil Blue, Chrome Yellow, quinacridone, Benzedrine Yellow, Rose Bengale, triarylmethane dye, monoazo dye and pigment, and disazo dye and pigment. These dyes and pigments can be employed alone or in combination.

For the purpose of controlling triboelectricity of the toner, a charge controlling agent may be incorporated into the toner. Examples of the charge controlling agent include organic metal complexes and chelate compounds such as a metal complex of a mono-azo dye; humic or nitrohumic acid or a salt thereof; metal complexes (e.g. Co, Cr, and Fe metal complexes) of aromatic hydroxycarboxylic or dicarboxylic acids such as salicylic acid, naphthoic acid and dicarboxylic acid; a quarternary ammonium compound; or an organic dye such as triphenylmethane dyes and nigrosine dyes.

If desired, the toner can contain a releasing agent, such as a low molecular weight polypropylene, a low molecular weight polyethylene, carnauba wax, micro-crystalline wax, jojoba wax, rice wax or montan wax. These materials may be used alone or in combination.

For the purpose of improving desired properties of the toner such as transferability to an electrostatic latent image-bearing surface, mixing efficiency and uniformity in charge characteristics, various known additives may be added to the toner. Such additives may include a lubricant such as organic polymer powder (e.g. polytetrafluoroethylene) or metal soap (e.g. zinc stearate); a polishing agent (e.g. cerium oxide or silicon carbide); a fluidity improving agent such as metal oxide powder (e.g. silica, alumina or titania) or hydrophobic metal oxide powder. It is preferable that the above-mentioned finely-divided particles have a hydrophobic surface in view of the improvement in fluidity and retention of electric charge. The surface of the metal oxide particles can be hydrophobized by use of any known suitable silicon compound such as a silane coupling agent, a silicone oil or a silylation agent.

Examples of the silylation agent include an organic silane such as chlorosilane (e.g. trichlorosilane), alkylchlorosilane and derivatives thereof (e.g. methyldichlorosilane, dimethyldichlorosilane, trimethylchlorosilane, ethyldichlorosilane, diethylchlorosilane, triethylchlorosilane, propyldichlorosilane, dipropyldichlorosilane, tripropylchlorosilane and fluoroalkylchlorosilane), arylchlorosilane (e.g. phenylchlorosilane), alkoxysilane and derivatives thereof (methyltrialoxysilane, dimethyldialkoxysilane, trimethylalkoxysilane, ethyldialkoxysilane, diethylalkoxysilane, triethylalkoxysilane, propyltrialkoxysilane, dipropyldialkoxysilane, tripropylalkoxysilane, phenylalkoxysilane, fluoroalkylalkoxysilane, perfluoroalkylalkoxysilane); organic silylamine and derivatives thereof (e.g. hexamethylsilazane, diethylaminotrimethylsilane and diethylaminotrimethylsilane); organic silylamide and derivatives thereof (NO-bistrimethylsilylacetamide, N-trimethylsilylacetamide, bistrimethylsilyl-trifluoroacetamide); siloxane and derivatives thereof (e.g. disiloxane and hexamethyldicyloxane); silicone oil and fluorine-substituted silicone oil (e.g. dimethylsilicone oil); and other silylation agents.

The following examples will further illustrate the present invention. Parts are by weight.

CARRIER PREPARATION EXAMPLE 1

A MnMgSr ferrite core material (I) having a weight average particle diameter (measured using a microtrack) of 36.1 μm and providing a magnetic moment of 77 emu/g when applied with a magnetic field of 1 KOe (measured using a multi-sample rotary magnetization measuring device Model REM-1-10 manufactured by Toei Industry Co., Ltd.) was used.

Alumina fine powder (number average particle diameter: 0.4 μm, electric resistance: $1\times10^3$ Ω·cm) as a first electric resistance controlling agent, titania fine powder (anatase, number average particle diameter: 0.2 μm, electric resistance: $1\times10^7$ Ω·cm) as a second electric resistance controlling agent and a silicone resin (SR2411, made by Dow Corning Toray Silicone Co., Ltd.) were dispersed in toluene for 30 minutes. The amounts of the alumina and titania were each 4% by weight based on the weight of the solid matter content of the silicone resin. This was then diluted with toluene to obtain a dispersion having a solid matter content of 10% by weight.

Using the thus obtained dispersion, 5 kg of the above core material (I) were coated at 100° C. using a fluidized bed coating device at a dispersion feed rate of about 50 g/min. The coated product was heated at 300° C. for 2 hours to obtain Carrier No. 1 having a resin layer covering the core material (I) with an average thickness of 0.61 μm. The electric resistance of Carrier No. 1 was $1.5\times10^{13}$ Ω·cm.

CARRIER PREPARATION EXAMPLE 2

Carrier Preparation Example 1 was repeated in the same manner as described except that the amounts of the alumina powder (first electric resistance controlling material) and titania powder (second electric resistance controlling material) were changed to 8% by weight and 2% by weight, respectively, based on the weight of the solid matter content of the silicone resin, thereby obtaining Carrier No. 2 having a resin layer with an average thickness of 0.60 μm. The electric resistance of Carrier No. 2 was $3.2\times10^{12}$ Ω·cm.

CARRIER PREPARATION EXAMPLE 3

Carrier Preparation Example 1 was repeated in the same manner as described except that Sn-doped titania (number average particle diameter: 0.3 μm, electric resistance: $1\times10^2$ Ω·cm) was used as the first electric resistance controlling agent in place of alumina, thereby obtaining Carrier No. 3 with an average thickness of 0.64 μm. The electric resistance of Carrier No. 3 was $2.1\times10^{12}$ Ω·cm.

CARRIER PREPARATION EXAMPLE 4

Carrier Preparation Example 3 was repeated in the same manner as described except that the amount of the titania powder (second electric resistance controlling material) was changed to 6% by weight based on the weight of the solid matter content of the silicone resin, thereby obtaining Carrier No. 4 with an average thickness of 0.62 μm. The electric resistance of Carrier No. 4 was $4.1\times10^{11}$ Ω·cm.

CARRIER PREPARATION EXAMPLE 5

Carrier Preparation Example 3 was repeated in the same manner as described except that carbon black (Ketchen Black EC-DJ600 manufactured by Lion Akzo Co., Ltd., electric resistance: $1\times10^1$ Ω·cm) was used as the first electric resistance controlling material in place of Sn-doped titania, thereby obtaining Carrier No. 5 with an average thickness of 0.61 μm. The electric resistance of Carrier No. 5 was $1\times10^{13}$ Ω·cm. The amounts of the carbon black (first electric resistance controlling material) and titania (second electric resistance controlling material) were 0.5% by weight and 6% by weight, respectively, based on the weight of the solid matter content of the silicone resin.

CARRIER PREPARATION EXAMPLE 6

Carrier Preparation Example 5 was repeated in the same manner as described except that an aminosilane coupling agent $H_2N(CH_2)_2NHCH_2Si(OCH_3)_3$ (MW: 194.3) was additionally added to the dispersion in an amount of 7% by weight based on the weight of the solid matter content of the silicone resin, thereby obtaining Carrier No. 6 with an average thickness of 0.60 μm. The electric resistance of Carrier No. 6 was $5.2\times10^{14}$ Ω·cm.

CARRIER PREPARATION EXAMPLE 7

Carrier Preparation Example 5 was repeated in the same manner as described except that an aminosilane coupling agent $H_2N(CH_2)_2NHCH_2Si(OCH_3)_3$ (MW: 194.3) was additionally added to the dispersion in an amount of 2% by weight based on the weight of the solid matter content of the silicone resin, thereby obtaining Carrier No. 7 with an average thickness of 0.61 μm. The electric resistance of Carrier No. 7 was $7.7\times10^{14}$ Ω·cm.

CARRIER PREPARATION EXAMPLE 8

Carrier Preparation Example 5 was repeated in the same manner as described except that carbon black (first electric resistance controlling material), titania powder (second electric resistance controlling material) and an aminosilane coupling agent $H_2N(CH_2)_2NHCH_2Si(OCH_3)_3$ (MW: 194.3) were used in amounts of 8% by weight, 0.2% by weight and 2% by weight, respectively, based on the weight of the solid matter content of the silicone resin, thereby obtaining Carrier No. 8 with an average thickness of 0.62 μm. The electric resistance of Carrier No. 8 was $3.1\times10^{15}$ Ω·cm.

CARRIER PREPARATION EXAMPLE 9

Carrier Preparation Example 5 was repeated in the same manner as described except that carbon black (first electric resistance controlling material), titania powder (second electric resistance controlling material) and an aminosilane coupling agent $H_2N(CH_2)_2NHCH_2Si(OCH_3)_3$ (MW: 194.3) were used in amounts of 5% by weight, 2.5% by weight and 7% by weight, respectively, based on the weight of the solid matter content of the silicone resin, thereby obtaining Carrier No. 9 with an average thickness of 0.61 μm. The electric resistance of Carrier No. 9 was $2.8\times10^{11}$ Ω·cm.

| Preparation of Toner (I): | |
|---|---|
| Polyester resin | 60 parts |
| Styrene-acrylic resin | 25 parts |
| Carnauba wax | 5 parts |
| Carbon black (tradenamed as #44, manufactured by Mitsubishi Chemical Corp.) | 10 parts |
| Chromium-containing monoazo complex (tradenamed as T-77 manufactured by Hodogaya Kagaku Co., Ltd.) | 3 parts |

The above components were mixed using a blender. The mixture was kneaded using a biaxial kneader. The kneaded mixture was cooled, pulverized using a jet mill and classified. The thus obtained mother toner had a number average particle diameter of 5.8 μm and a volume average particle diameter of 6.8 μm. To the mother toner particles (100 parts), 0.7 part of hydrophobic silica (R972 manufactured by Nihon Aerosil Inc.) and 0.1 part of hydrophobic titania (MT150A, manufactured by Teika Co., Ltd., hydrophobized with isobutyltrimethoxysilane) as an external additive, mixed using HENSCHEL MIXER and classified to remove large particles, thereby obtaining Toner (I) having a number average particle diameter of 6.2 μm and a volume average particle diameter of 7.4 μm.

EXAMPLE 1

Preparation of Developer No. 1:

5 Parts of Toner (I) obtained above and 95 parts of Carrier No. 1 obtained above were thoroughly mixed to obtain a two-component developer No. 1.

Formation of Image:

The developer No. 1 thus obtained was charged in a developing unit of a copying machine (IMAGIO MF4570 manufactured by Ricoh Company, Ltd.). While replenishing the toner, a letter image chart (image area: 6%) was reproduced to obtain 100,000 copies using the copying machine operated at a charging potential of −850 V and a development bias of −600 V. Various tests were carried out to evaluate the developer No. 1 as follows:

(1) Charging Amount:

Before and after the production of 100,000 copies, a portion of the developer is sampled to measure the amount of charge (μC/g).

(2) Background Stains:

A white image is produced while applying a bias voltage of −700V to the developer carrying roller. Background stains are observed with naked eyes and evaluated according to the following ratings:

A: Excellent
B: Good
C: Fair (acceptable)
D: No good (not acceptable)

(3) Toner Scattering:

Extent of toner scattered in the machine is visually observed, after 100,000 copies have been produced, and comprehensively evaluated according to the following ratings:

A: Excellent (No toner scattering observed)
B: Good (Slight toner scattering observed)
C: Fair (Toner scattering observed to an extent that should cause no practical problem)
D: No good (Toner scattering significantly observed to an extent that may cause practical problem)

(4) Saturated ID:

A solid image is outputted, and the image density of the solid image is measured at three arbitrary positions using a Macbeth densitometer. The average of the image density is calculated as saturated image density. Evaluation is rated as follows:

A: 1.4 or more (excellent)
B: 1.3 or more but less than 1.4 (good)
C: 1.2 or more but less than 1.3 (fair (acceptable))
D: less than 1.2 (no good (not acceptable))

(5) Halftone Uniformity:

A dot matrix pattern image (16 gradations) is outputted under the conditions of 600 dot/inch and 150 line/inch in both the main scanning direction and the sub-scanning direction. The obtained pattern is observed to evaluate the uniformity with respect to omission of dots, gradation and uniformity in image density. The evaluation is rated as follows:

A: Excellent
B: Good
C: Fair (acceptable)
D: No good (not acceptable)

(6) Abnormal Image:

Copies of an image bearing chart in which two kinds of halftone areas (1 cm×1 cm) with image densities of 0.2 and 0.8 (as measured with Macbeth reflection type densitometer) are alternately arranged in the transporting direction of paper are outputted. A decrease in image density at the end of each halftone area is visually observed. Freedom of abnormal image is evaluated according to the following ratings:

A: Excellent (No decrease)
B: Good (Slight decrease)
C: Fair (an acceptable degree of decrease)
D: No good (considerable decrease (not acceptable))

(7) Carrier Deposition:

A white image is outputted while applying a voltage of 450 V to the developer carrying roller. During the image production, the power source of the copying machine is off to obtain a developed, untransferred toner image on the photoconductor. The white image portion on the photoconductor is observed with a microscope to count the number of the carrier particles that are present on the white image portion in an area of 10 cm (along the axial direction of the photoconductor)×2 cm (direction normal to the axial direction). Carrier deposition is evaluated according to the following ratings:

A: Excellent (0-5 spots)
B: Good (6-10 spots)
C: Fair (11-20 spots)
D: No good (more than 20 spots)

(8) White Spot

A solid image (A4 size) is outputted, and the number of white spots are counted. The white spot is evaluated according to the following ratings:
A: Excellent (0-5 spots)
B: Good (6-10 spots)
C: Fair (11-20 spots)
D: No good (more than 20 spots)

(9) Reproducibility of Fine Line Image:

A one-dot lattice line image is outputted under the conditions of 600 dot/inch and 150 line/inch in both the main scanning direction and the sub-scanning direction. The obtained lines are visually evaluated whether the lines are broken or blurred. The evaluation is rated as follows:
A: Excellent
B: Good
C: Fair (acceptable)
D: No good (not acceptable)

(10) Resolution:

One-dot images are independently outputted under the conditions of 600 dot/inch and 300 line/inch in both the main scanning direction and the sub-scanning direction. The obtained dot images are visually evaluated from the viewpoints of absence of a dot and unevenness of image density. The reproducibility of dot images is observed as an indication of the resolution. The evaluation is rated as follows:
A: Excellent
B: Good
C: Fair (acceptable)
D: No good (not acceptable)

The results are summarized in Table 1.

EXAMPLES 2-9

Example 1 was repeated in the same manner as described except that each of Carrier No. 2 through Carrier No. 9 was substituted for Carrier No. 1. The test results are shown in Table 1.

COMPARATIVE EXAMPLE 1

Carrier Preparation Example 3 was repeated in the same manner as described except that the second electric resistance controlling material (titania powder) was not used at all (namely, only the first electric resistance controlling material (Sn-doped titania) was used by itself) to obtain Comparative Carrier No. 1. This was mixed with Toner (I) to obtain Comparative Developer No. 1. Comparative Developer No. 1 was tested in the same manner as described in Example 1. The results are shown in Table 1.

COMPARATIVE EXAMPLE 2

Carrier Preparation Example 5 was repeated in the same manner as described except that the second electric resistance controlling material (carbon black, Ketchen Black EC-DJ600) was used in an amount of 3% by weight based on the weight of the solid matters of the silicon resin and that the second electric resistance controlling material (titania powder) was not used at all to obtain Comparative Carrier No. 2. This was mixed with Toner (I) to obtain Comparative Developer No. 2. Comparative Developer No. 2 was tested in the same manner as described in Example 1. The results are shown in Table 1.

COMPARATIVE EXAMPLE 3

Carrier Preparation Example 3 was repeated in the same manner as described except that the amount of the first electric resistance controlling material (Sn-doped titania) was reduced to 2% by weight and that the second electric resistance controlling material (titania powder) was replaced by silica fine powder having a number average particle diameter of 0.6 μm (which is greater than 1/10 of 5.8 μm of the number average particle diameter of Toner (I)) to obtain Comparative Carrier No. 3. This was mixed with Toner (I) to obtain Comparative Developer No. 3. Comparative Developer No. 3 was tested in the same manner as described in Example 1. The results are shown in Table 1.

EXAMPLE 10

In a copying machine (imagio MF4570 manufactured by Ricoh Company, Ltd.), the magnetized width of a magnet of a developing sleeve roller was adjusted so as to have a value L of 0.2 mm when the developing sleeve roller was located nearest to the photoconductor drum. With this copying machine, image formation was carried out at Vp of 230 mm/sec, Vr of 414 mm/sec. Thus, $L\times\{(Vr/Vp)-1\}$ was 0.16 mm. Namely, the image formation was carried out while displacing the image forming member and the developer carrying member in the same direction (i.e. while rotating the image forming member and the developer carrying member in opposite directions) at different linear speeds Vp (=230 mm/sec) and Vr (=414 mm/sec), respectively, and while maintaining the length of contact between the image forming member and the developer in the displacing direction thereof at L (0.2 mm).

The magnetic pole located nearest to the photoconductor drum was divided into three sections such that the center section has a magnetic pole opposite to those of the adjacent two sections.

5 Parts of Toner (I) obtained above and 95 parts of Carrier No. 9 obtained above were thoroughly mixed to obtain a two-component developer No. 9. The developer No. 9 thus obtained was charged in a developing unit of the above copying machine. While replenishing the toner, a letter image chart (image area: 6%) was reproduced to obtain 100,000 copies using the copying machine operated at a charging potential of −850 V and a development bias of −600 V. Various tests were carried out in the same manner as that in Example 1. The results are shown in Table 1.

EXAMPLE 11

Example 10 was repeated in the same manner as described except that L of 1 mm, Vp of 230 mm/sec and Vr of 575 mm/sec were employed so that $L\times\{(Vr/Vp)-1\}$ was 1.5 mm. The results are shown in Table 1.

EXAMPLE 12

Example 10 was repeated in the same manner as described except that L of 0.4 mm, Vp of 230 mm/sec and Vr of 575 mm/sec were employed so that $L\times\{(Vr/Vp)-1\}$ was 0.6 mm. The results are shown in Table 1.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Application No. 2002-079898, filed Mar. 22, 2002, inclusive of the specification, claims and drawings, are hereby incorporated by reference herein.

TABLE 1

| Example No. | Carrier No. | Charge Amount (μC/g) Initial | Charge Amount (μC/g) After $10^5$ copies | Background Stains | Saturated I.D. | Half Tone Uniformity |
|---|---|---|---|---|---|---|
| 1 | 1 | −22.1 | −19.3 | C | B | A |
| 2 | 2 | −23.4 | −20.1 | B | C | A |
| 3 | 3 | −22.2 | −20.0 | C | C | A |
| 4 | 4 | −23.1 | −21.1 | B | V | B |
| 5 | 5 | −25.4 | −24.1 | B | V | B |
| 6 | 6 | −26.4 | −27.1 | B | V | B |
| 7 | 7 | −27.4 | −25.8 | A | A | C |
| 8 | 8 | −24.7 | −23.3 | B | B | A |
| 9 | 9 | −25.1 | −24.8 | A | A | A |
| Comp. 1 | Comp. 1 | −19.4 | −18.7 | D | D | B |
| Comp. 2 | Comp. 2 | −23.3 | −21.1 | D | D | B |
| Comp. 3 | Comp. 3 | −19.9 | −16.4 | D | D | B |
| 10 | 9 | −25.2 | −24.9 | A | A | A |
| 11 | 9 | −25.2 | −23.7 | A | A | A |
| 12 | 9 | −25.2 | −24.1 | A | A | A |

TABLE 2

| Example No. | Carrier No. | Abnormal Image | Carrier Deposition | White Spot | Fine Line Reproducibility | Resolution |
|---|---|---|---|---|---|---|
| 1 | 1 | B | B | A | C | C |
| 2 | 2 | B | A | A | C | C |
| 3 | 3 | B | A | A | B | B |
| 4 | 4 | B | A | A | B | B |
| 5 | 5 | B | A | A | B | B |
| 6 | 6 | B | A | A | B | B |
| 7 | 7 | B | A | A | C | C |
| 8 | 8 | B | A | A | B | B |
| 9 | 9 | B | A | A | B | B |
| Comp. 1 | Comp. 1 | B | D | D | C | C |
| Comp. 2 | Comp. 2 | B | D | D | B | B |
| Comp. 3 | Comp. 3 | B | C | D | D | D |
| 10 | 9 | A | A | A | B | B |
| 11 | 9 | A | A | A | A | A |
| 12 | 9 | A | A | A | A | A |

What is claimed is:

1. A carrier for use with a toner as a two-component developer for developing an electrostatic image, comprising:

spherical magnetic core particles, and a resin layer covering each of said core particles and containing at least a first resistance controlling material and a second resistance controlling material, wherein the first resistance controlling material and the second resistance controlling materials have different specific resistances, wherein each of said first and second resistance controlling materials is in the form of particles having a number average particle diameter of no more than 1/10 of a number average particle diameter of the toner, wherein either the first or the second resistance controlling material is an Sn-doped titania, and wherein the first resistance controlling material has a specific resistance of $1\times10^3$ Ω·cm or less and the second resistance controlling material has a specific resistance of $5\times10^7$ Ω·cm or less.

2. A carrier as claimed in claim 1, wherein the number average particle diameter of each of said resistance controlling materials is smaller than an average thickness of said resin layer.

3. A carrier as claimed in claim 1, wherein the average thickness of said resin layer is in the range of from 0.4 μm to 2 μm.

4. A carrier as claimed in claim 1, wherein said resin layer contains a charge controlling agent.

5. A carrier as claimed in claim 4, wherein said charge controlling agent is a silane coupling agent.

6. The carrier as claimed in claim 5, wherein the silane coupling agent comprises at least one selected from the group consisting of $H_2N(CH_2)_3Si(OCH_3)_3$,
$H_2N(CH_2)_3Si(OC_2H_5)_3$,
$H_2N(CH_2)_3Si(CH_3)_2OC_2H_5$,
$H_2N(CH_2)_3SiCH_3(OC_2H_5)_2$,
$H_2N(CH_2)_2NHCH_2Si(OCH_3)_3$,
$H_2N(CH_2)_2NH(CH_2)_3SiCH_3(OCH_3)_2$,
$H_2N(CH_2)_2NH(CH_2)_3Si(OCH_3)_3$,
$(CH_3)_2N(CH_2)_3SiCH_3(OC_2H_5)_2$, and
$(C_4H_9)_2N(CH_2)_3Si(OCH_3)_3$.

7. A carrier as claimed in claim 1 having a specific resistance of $10^7$ to $10^{16}$ Ω·cm.

8. A developer for developing an electrostatic image, comprising a non-magnetic toner having a number average particle diameter in the range from 5 μm to 8 μm, and a carrier according to claim 1.

9. A carrier as claimed in claim 1, wherein the resin layer further comprises a resistance controlling material which comprises a carbon black.

10. An image forming method comprising contacting an image forming member bearing an electrostatic latent image thereon with a developer according to claim 8 magnetically supported on a developer carrying member, while impressing an electric potential between said image forming member and said developer carrying member, to electrostatically move said toner of said developer to the electrostatic latent image and to form a toner image on said image forming member.

11. An image forming method as claimed in claim 10, wherein said contacting is carried out while displacing said image forming member and said developer carrying member at different linear speeds Vp [mm/sec] and Vr [mm/sec], respectively, and while maintaining the length of contact between said image forming member and said developer in the displacing direction thereof at L [mm], and wherein Vp, Vr and L meet the following condition:

$$0.1 \leqq L \times \{(Vr/Vp)-1\} \leqq 2.$$

12. A two-component developer comprising a carrier and a toner, wherein the carrier comprises spherical magnetic core particles each covered with a resin layer comprising at least a first and a second resistance controlling material having different specific resistances, wherein each of said first and said second resistance controlling materials is in the form of particles having a number average particle diameter of no more than 1/10 of the number average particle diameter of the toner, wherein either the first or the second resistance controlling material is an Sn-doped titania, and wherein the first resistance controlling material has a specific resistance of $1\times10^3$ Ω·cm or less and the second resistance controlling material has a specific resistance of $5\times10^7$ Ω·cm or less, and wherein one of the first or the second resistance controlling materials comprises particles of a metal oxide treated to have electrical conductivity.

13. The developer as claimed in claim 12, wherein the number average particle diameter of each of said resistance controlling materials is smaller than an average thickness of said resin layer.

14. The developer as claimed in claim 12, wherein the average thickness of the resin layer is from 0.4 μm to 2 μm.

15. The developer as claimed in claim 12, wherein said resin layer contains a charge controlling agent.

16. The developer as claimed in claim 15, wherein said charge controlling agent is a silane coupling agent.

17. The developer as claimed in claim 16, wherein the silane coupling agent is at least one selected from the group consisting of $H_2N(CH_2)_3Si(OCH_3)_3$,
$H_2N(CH_2)_3Si(OC_2H_5)_3$,
$H_2N(CH_2)_3Si(CH_3)_2OC_2H_5$,
$H_2N(CH_2)_3SiCH_3(OC_2H_5)_2$,
$H_2N(CH_2)_2NHCH_2Si(OCH_3)_3$,
$H_2N(CH_2)_2NH(CH_2)_3SiCH_3(OCH_3)_2$,
$H_2N(CH_2)_2NH(CH_2)_3Si(OCH_3)_3$,
$(CH_3)_2N(CH_2)_3SiCH_3(OC_2H_5)_2$, and
$(C_4H_9)_2N(CH_2)_3Si(OCH_3)_3$.

18. The developer as claimed in claim 12, wherein the resin layer further comprises a resistance controlling material which comprises a carbon black.

* * * * *